US005313757A

United States Patent [19]

Schnepf

[11] Patent Number: 5,313,757

[45] Date of Patent: May 24, 1994

[54] REINFORCING BAR PROTECTION CAP

[76] Inventor: Kurt E. Schnepf, 20 The Boulevard, Montrose, Victoria, 3567, Austral, Australia

[21] Appl. No.: 29,923

[22] Filed: Mar. 11, 1993

Related U.S. Application Data

[63] Continuation of Ser. No. 727,562, Jul. 9, 1991, abandoned.

[51] Int. Cl.[5] ..... B65D 59/06

[52] U.S. Cl. ..... 52/301; 138/96 R; 285/92

[58] Field of Search ..... 52/301; 138/96 R, 982; 256/1.32, DIG. 5; 285/901, 92

[56] References Cited

U.S. PATENT DOCUMENTS 4,202,378 5/1980 Bush et al. ..... 138/96 R
4,785,858 11/1988 Valentini et al. ..... 285/92 X
4,833,850 5/1989 Lunn ..... 52/301

FOREIGN PATENT DOCUMENTS 0963741 7/1964 United Kingdom ..... 138/96 R

*Primary Examiner*—Carl D. Friedman
*Assistant Examiner*—Wynn E. Wood
*Attorney, Agent, or Firm*—Volpe and Koenig

[57] ABSTRACT

A reinforcing bar protection cap for location over the exposed end of a concrete reinforcing bar so as to protect against injury to workers. The cap includes a load spreading cap with a metal reinforcing disc, a support portion comprising a generally cylindrical housing, the load spreading cap closing the inner end of the housing. Three generally radial retaining webs engage with the reinforcing bar to locate and retain the cap at the end of the bar. The radial outer edges of the webs are generally parallel to the axis of the cylindrical body and define hinging or flexing lines for the respective webs whereby the retaining webs contact the reinforcing bar along respective lines of contact extending axially along the bar. The retaining webs are mounted to the cylindrical body only and are not connected to the load spreading cap.

14 Claims, 1 Drawing Sheet

REINFORCING BAR PROTECTION CAP

Figure 2:
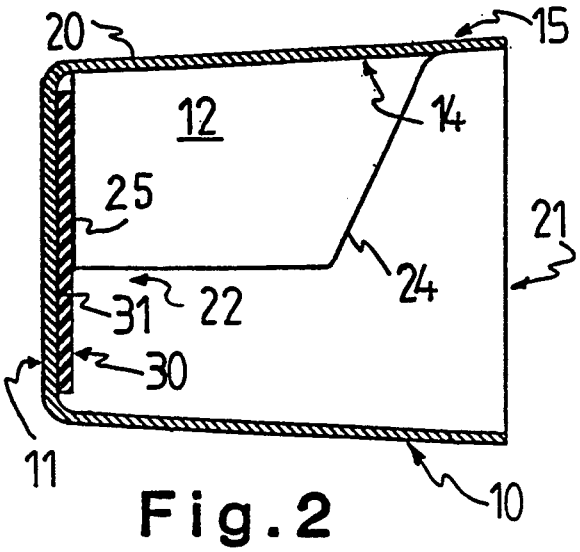

This application is a continuation of application Ser. No. 07/727,562, filed Jul. 9, 1991 now abandoned.

This invention relates to caps which in use are placed over the exposed ends of reinforcing bars which project from structural work involving pouring of concrete around the reinforcing bars.

There is currently available a reinforcing bar protection cap made of a plastics material which is arranged to fit over the end of an exposed reinforcing bar, particularly one which may be dangerous to workers passing by the exposed end or falling onto such an exposed end. The currently known protection cap is a generally cylindrical article having three generally radially directed webs which are moulded with the body. The webs are equally spaced around the axis and project inwardly so as to engage with the end of the reinforcing bar. This cap is moulded such that the webs are integral with the closed end of the body so that when the cap is fitted over the end of bar, the webs which project inwardly engage with the bar by their resilient movement. These webs tend to adopt an angle relative to the axis of the bar so that when the cap is knocked by a passer-by or there is some vibration in the reinforcing bar, the angled webs experience an axial force tending to push the cap on the end of the rod. In fact, this problem is observed in practice when the caps are frequently found to be readily dislodged by accidentally bumping the cap attached to the end of the bar.

Another problem with the existing protection cap is that the end of the cap which extends over the end of the bar, is readily ruptured when an impact force is applied axially. In particular, the end of the reinforcing bar pierces the protection cap and can therefore cause injury to a workman or passer-by.

A further problem with the protective cap currently known and described above is that the caps are not stackable.

It is an object of the present invention to provide a reinforcing bar protection cap which is particularly effective in operation.

It is a further and preferred object of the present invention to provide a reinforcing bar protection cap which is less prone to dislodgement from the end of a reinforcing bar.

A further and preferred object of the present invention is to provide a reinforcing bar protection cap which can have significantly improved resistance to piercing by the end of the reinforcing bar upon the application of an impact load acting axially on the protection cap.

It is a yet further preferred object to provide a reinforcing bar protection cap which can be stackable and therefore enable the user to carry a large number of the protection caps.

According to the present invention there is provided a reinforcing bar protection cap for location over the exposed end of a concrete reinforcing bar so as to protect against injury to workers, the protection cap including: a load spreading cap portion which in use is arranged to be located over the end of the bar so that contact with the end of the bar from the general axial direction is intercepted by the load spreading cap portion; at least two retaining members for engagement with the reinforcing bar so as to locate and retain the load spreading cap at the end of the bar; a support portion for the load spreading cap, the support portion generally surrounding the end of the bar in use, the retaining members being arranged to contact and to bear against the bar at points located lengthwise of the bar, the retaining members being resiliently movable so as to contact the bar so that the contact points are along respective contact lines which are substantially parallel to the axis of the bar so that there is no significant inclination of the contact lines in the axial direction which would otherwise cause a tendency of the bar protection cap to creep along the bar and disengage from the end thereof.

Preferably the retaining members are arranged to extend towards and to contact the bar generally tangentially. There may be at least three retaining members arranged generally symmetrically around the axis of the reinforcing bar so as to contact the reinforcing bar along respective lines of contact extending substantially axially along the bar. In this embodiment, each of the retaining members may comprise a web which arcuate in the generally radial direction, the concave face of each web facing generally towards the axis of the reinforcing bar so that the retaining webs together generally define a concave polygonal enclosure for receiving the end of the reinforcing bar and thereby resist axial force applied to the protection cap causing displacement of the protection bar from a central axial position in which it is engaged by all the retaining webs.

In the preferred construction the retaining members comprise respective retaining webs mounted to the support portion and extending generally radially but not directly towards the axis of the bar, the radial outer end of each of the webs being generally parallel to the bar axis and defining hinge or flexing lines for the respective webs and which are generally parallel to the bar axis.

The support portion may comprise a surrounding housing having a generally cylindrical body, the load spreading cap being located at and closing an inner end of the housing, the outer end of the housing being open so as to receive therein the end of the bar. In this embodiment, preferably the retaining members are mounted to the generally cylindrical housing only and are not connected to the load spreading cap whereby the retaining members can generally pivot or flex relative to their respective outer ends which are secured to the generally cylindrical housing and without constraint of movement being caused by attachment to the load spreading cap.

Preferably the retaining members are each provided with a chamfered outer edge sloping generally radially inwardly towards the load spreading cap whereby the chamfered outer edges guide the end of the reinforcing bar centrally into the generally cylindrical support portion. The outer edge of each of the retaining members may terminate before the outer open end of the generally cylindrical support portion remote from the load spreading cap, the inner end of the generally cylindrical support portion being provided with an outer diameter approximately equal to the inside diameter of the outer end of the support portion whereby the inner end of the protection cap may be fitted relatively closely within the outer end of a similar protection cap.

The load spreading cap preferably has structurally resistant properties so as to strongly resist penetration of the load spreading cap by the end of the bar upon placing a substantial impulse loading upon the load spreading cap. For this purpose, the load spreading cap may include a substantially impenetrable portion against which in use the end of the reinforcing bar bears, the impenetrable portion strongly resisting piercing of the load spreading cap by the end of the bar. The substantially impenetrable portion may comprise a metal disc for bearing the load of the end of a reinforcing bar against which the protection cap is forced by an external impulse loading. The impenetrable portion may comprise an insert portion which is moulded inside of the protection cap and to which the support portion is securely fastened.

The present invention also provides a reinforcing bar protection cap for location over the exposed end of a concrete reinforcing bar so as to protect against injury to workers, the protection cap including: a load spreading cap portion which in use is arranged to be located over the exposed end of the bar so that contact with the end of the bar from the general axial direction is intercepted by the load spreading cap portion; a support portion comprising a housing having a generally cylindrical body, the body having an inner end and an outer end, the load spreading cap being located at and closing the inner end of the housing, the outer end of the housing being open so as to receive therein the end of the bar; at least three retaining members for engagement with the reinforcing bar so as to locate and retain the load spreading cap at the end of the bar, the retaining members comprising retaining webs having radial outer edges mounted to the generally cylindrical body of the housing and being arranged generally symmetrically around the axis of the cylindrical body and extending inwardly generally radially but not directly towards the axis of the cylindrical body, the radial outer edges of the webs being generally parallel to the axis of the cylindrical body and defining hinging or flexing lines for the respective webs whereby the retaining webs contact the reinforcing bar along respective lines of contact extending substantially axially along the bar, the retaining webs being mounted to the cylindrical body only and not being connected to the load spreading cap so that the retaining webs can generally pivot or flex at their respective outer edges without constraint of such pivoting or flexing movement being caused by connection to the load spreading cap and whereby the respective lines of contact of the retaining webs with the bar are substantially parallel the axis of the bar and so that there is no significant inclination of the lines of contact in the axial direction which would otherwise cause a tendency of the bar protection cap to creep along the bar and disengage from the end thereof.

Preferably the load spreading cap includes a substantially impenetrable metal disc for resisting piercing of the load spreading cap by the end of the bar upon an external impulse loading being applied externally to the protection cap. The metal disc preferably comprises an insert which is moulded inside the protection cap and to which the support portion is securely attached. The insert metal disc is preferably moulded at the inside face of the load spreading cap portion, the retaining webs being moulded integrally with the cylindrical body and with the load spreading cap portion so that the retaining webs extend axially and abut the insert metal disc but without being secured or adhering to the metal disc whereby the retaining webs can flex or pivot without being constrained in movement by attachment or adhesion to the metal disc.

Figure 1:
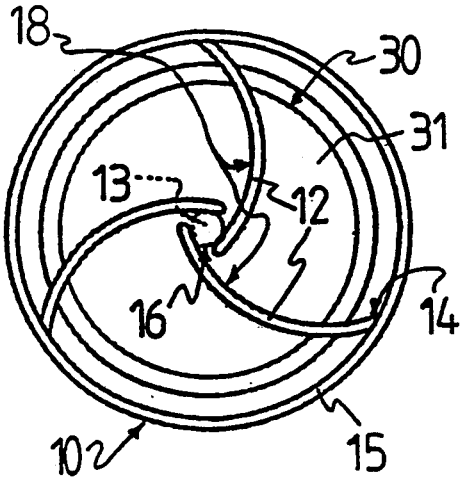
Figure 3:
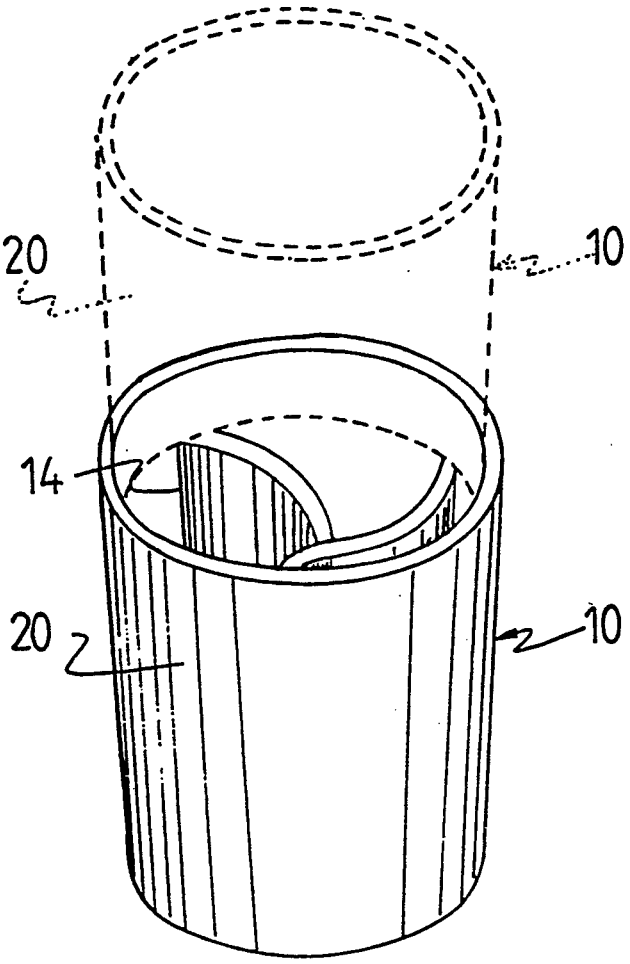

Possible and preferred features of the present invention will now be described with particular reference to the accompanying drawings. However it is to be understood that the features illustrated in and described with reference to the drawings are not to be construed as limiting on the scope of the invention. In the drawings:

FIG. 1 shows an end view of a reinforcing bar protection cap according to a preferred embodiment of the present invention, FIG. 2 shows a longitudinal section through the protection cap shown in FIG. 1, and showing one only of the retaining webs, and FIG. 3 is a schematic perspective view of a protection cap according to FIG. 1 and 2 and showing the stacking characteristics.

The reinforcing bar protection cap 10 locates over the exposed end of a concrete reinforcing bar 13 so as to protect against injury to workers. The protection cap includes a load spreading cap portion 11 which in use is located over the end of the bar 13 so that contact with the end of the bar from the general axial direction is intercepted by the load spreading cap portion 11. Three retaining members 12 engage with the reinforcing bar 13 so as to locate and retain the load spreading cap 10 at the end of the bar. A support portion 15 for the load spreading cap 11 generally surrounds the end of the bar 13 in use. The retaining members 12 are arranged to contact and to bear against the bar 13 at points located lengthwise of the bar. The retaining members 12 are resiliently movable so as to contact the bar 13 so that the contact points are along respective contact lines which are substantially parallel to the axis of the bar 13 so that there is no significant inclination of the contact lines in the axial direction which would otherwise cause a tendency of the bar protection cap 10 to creep along the bar 13 and disengage from the end thereof.

The retaining members 12 are arranged to extend towards and to contact the bar 13 generally tangentially as shown in FIG. 1. The three retaining members 12 are arranged generally symmetrically around the axis of the reinforcing bar 13 so as to contact the reinforcing bar along respective lines of contact extending substantially axially along the bar. Each of the members comprises a web which is arcuate in the generally radial direction, the concave face 18 of each web facing generally towards the axis of the reinforcing bar 13 so that the retaining webs 12 together generally define a concave polygonal enclosure 16 for receiving the end of the reinforcing bar 13 and thereby resist axial force applied to the protection cap 10 causing displacement of the protection bar from a central axial position in which it is engaged by all the retaining webs 12.

The retaining webs 12 are mounted to the support portion 15 and extend generally radially but not directly towards the axis of the bar 13, the radial outer end 14 of each of the webs being generally parallel to the bar axis and defining hinge or flexing lines for the respective webs 12 and which are generally parallel to the bar axis.

The support portion 15 comprises a surrounding housing 20 having a generally cylindrical body, the load spreading cap 11 being located at and closing the inner end of the housing 20, the outer end 21 of the housing 20 being open so as to receive therein the end of the bar 13. The retaining webs 12 are mounted to the generally cylindrical housing 20 only and are not connected to the load spreading cap 11 whereby the retaining members 12 can generally pivot or flex relative to their respective outer ends 14 which are secured to the generally cylindrical housing 20 and without constraint of movement being caused by attachment to the load spreading cap 11.

The retaining members 12 are each provided with a chamfered outer edge 24 sloping generally radially inwardly towards the load spreading cap 11 whereby the chamfered outer edges 24 guide the end of the reinforcing bar 13 centrally into enclosure 16 in the support portion 15.

The outer edge 14 of each of the retaining members 12 terminates before the open outer end 21 of the support portion 15. The inner end 22 of the support portion 15 is provided with an outer diameter approximately equal to the inside diameter of the outer end 21 of the support portion whereby the inner end 22 of a protection cap 10 can be fitted relatively closely within the outer end 21 of a similar protection cap.

The load spreading cap 11 has structurally resistant properties so as to strongly resist penetration of the load spreading cap 11 by the end of the bar 13 upon placing a substantial impulse loading upon the load spreading cap 11. In the drawings, the load spreading cap 11 includes a substantially impenetrable portion 30 against which in use the end of the reinforcing bar 13 bears, the impenetrable portion 30 strongly resisting piercing of the load spreading cap 11 by the end of the bar 13. The substantially impenetrable portion 30 comprises a metal disc 31 for bearing the load of the end of a reinforcing bar 13 against which the protection cap 10 is forced by an external impulse loading.

The disc 31 comprises an inserted component which is moulded inside of the protection cap 10 and to which the support portion 15 is secured. However, when the protection cap 10 is moulded with the disc 31 located in the mould cavity, the retaining webs 12 will be simultaneously moulded and the inner ends 25 of the webs 12 will abut the metal disc 31. However the retaining webs 12 will not be retained at their inner ends 25 to the disc 31 because there will be no significant adhesion between the metal disc 31 and the plastics material from which the protection cap and particularly the retaining webs 12 are formed. This enables the webs 12 to flex or hinge about their radially outer ends 14 without restrained inner ends 25 causing the webs to skew when the cap is placed on a bar.

It will be seen that the preferred embodiment of the protection cap described and illustrated herein can be readily located and retained on the end of a reinforcing bar without a significant tendency to creep off the end of the bar. The cap can very strongly resist piercing of the cap causing injury. The caps can be readily stacked for storage and transport.

It is to be understood that various alterations, modifications and/or additions may be made to the features of the possible and preferred embodiment(s) of the invention as herein described without departing from the scope of the invention as defined in the appended claims.

I claim:

1. A reinforcing bar protection cap for location over the exposed end of a concrete reinforcing bar so as to protect against injury to workers, the protection cap including:

a load spreading cap which in use is arranged to be located over the exposed end of the bar so that contact with the end of the bar from the general axial direction is intercepted by the load spreading cap;

at least two retaining members for engagement with the reinforcing bar so as to locate and retain the load spreading cap at the end of the bar;

a support portion for the load spreading cap, the support portion generally surrounding the end of the bar in use, the retaining members being operatively connected to the support portion and arranged to contact and to bear against the bar at points located lengthwise of the bar, the retaining members being resiliently movable so as to contact the bar so that the contact points are along respective contact lines which are substantially parallel to the axis of the bar so that there is no significant inclination of the contact lines in the axial direction which would otherwise cause a tendency of the bar protection cap to creep along the bar and disengage from the end thereof;

the load spreading cap including a substantially impenetratable metal disc against which in use the end of the reinforcing bar bears, the metal disc strongly resisting piercing of the load spreading cap by the end of the bar upon the occurrence of an extremely applied substantial magnitude impulse loading upon the load spreading cap.

2. A protection cap as claimed in claim 1 wherein the retaining members are arranged to extend towards and to contact the bar generally tangentially.

3. A protection cap as claimed in claim 2 wherein there are at least three said retaining members arranged generally symmetrically around the axis of the reinforcing bar so as to contact the reinforcing bar along respective lines of contact extending substantially axially along the bar.

4. A protection cap as claimed in claim 3 wherein each of the retaining members comprises a web which is arcuate in the generally radial direction, the concave face of each web facing generally towards the axis of the reinforcing bar so that the retaining webs together generally define a concave polygonal enclosure for receiving the end of the reinforcing bar and thereby resist axial force applied to the protection cap causing displacement of the protection bar from a central axial position in which it is engaged by all the retaining webs.

5. A protection cap as claimed in claim 1 wherein the retaining members comprise respective retaining webs mounted to the support portion and extending generally radially but not directly towards the axis of the bar, the radial outer ends of each of the webs being generally parallel to the bar axis and defining hinge or flexing lines for the respective webs and which are generally parallel to the bar axis.

6. A protection cap as claimed in claim 1 wherein the support portion comprises a surrounding housing having a generally cylindrical body having an inner end and an outer end, the load spreading cap being located at and closing the inner end of the housing, the outer end of the housing being open so as to receive therein the end of the bar.

7. A protection cap a claimed in claim 6 wherein the retaining members are mounted to the generally cylindrical housing only and are not connected to the load spreading cap whereby the retaining members can generally pivot or flex relative to their respective outer ends which are secured to the generally cylindrical housing and without constraint of movement being caused by attachment to the load spreading cap.

8. A protection cap as claimed in claim 6 wherein each of the retaining members is provided with a chamfered outer edge sloping generally radially inwardly towards the load spreading cap whereby the chamfered outer edges of the retaining members guide the end of the reinforcing bar centrally into the generally cylindrical support portion.

9. A protection cap as claimed in claim 6 wherein the outer edge of each of the retaining members terminates before the outer open end of the generally cylindrical support portion remote from the load spreading cap, the inner end of the generally cylindrical support portion being provided with an outer diameter approximately equal to the inside diameter of the outer end of the support portion whereby the inner end of the protection cap may be fitted relatively closely within the outer end of a similar protection cap.

10. A protection cap as claimed in claim 1 wherein the impenetrable portion comprises an insert portion which is moulded inside of the protection cap and to which the support portion is securely fastened.

11. A reinforcing bar protection cap for location over the exposed end of a concrete reinforcing bar so as to protect against injury to workers, the protection cap including: a load spreading cap portion which in use is arranged to be located over the exposed end of the bar so that contact with the end of the bar from the generally axial direction is intercepted by the load spreading cap portion; a support portion comprising a housing having a generally cylindrical body, the body having an inner end and an outer end, the load spreading cap portion being located at and closing the inner end of the body, the outer end of the body being open so as to receive therein the end of the bar; at least three retaining members for engagement with the reinforcing bar so as to locate and retain the load spreading cap portion at the end of the bar, the retaining members comprising retaining webs having radial outer edges mounted to the generally cylindrical body of the housing and being arranged generally symmetrically around the axis of the cylindrical body and extending inwardly generally radially but not directly towards the axis of the cylindrical body, the radial outer edges of the webs being generally parallel to the axis of the cylindrical body and defining hinging or flexing lines for the respective webs whereby the retaining webs contact the reinforcing bar along respective lines of contact extending substantially axially along the bar, the retaining webs being mounted to the cylindrical body only and not being connected to the load spreading cap portion so that the retaining webs can generally pivot or flex at their respective outer edges without constraint of such pivoting or flexing movement being caused by connection to the load spreading cap portion and whereby the respective lines of contact of the retaining webs with the bar are substantially parallel to the axis of the bar and so that there is no significant inclination of the lines of contact in the axial direction which would otherwise cause a tendency of the bar protection cap to creep along the bar and disengage from the end thereof, the load spreading cap including a substantially impenetrable metal disc for resisting piercing of the load spreading cap by the end of the bar upon an external impulse loading being applied externally to the protection cap.

12. A protection cap as claimed in claim 11 wherein the metal disc comprises an insert which is moulded inside the protection cap and to which the support portion is securely attached.

13. A protection cap as claimed in claim 12 wherein the insert metal disc is moulded at the inside face of the load spreading cap portion, the retaining webs being moulded integrally with the cylindrical body and with the load spreading cap portion so that the retaining webs extend axially and abut the insert metal disc but without being secured or adhering to the metal disc whereby the retaining webs can flex or pivot without being constrained in movement by attachment or adhesion to the metal disc.

14. A reinforcing bar protection cap for location over the exposed end of a concrete reinforcing bar so as to protect against injury to workers, the protection cap including:

a load spreading cap which in use is arranged to be located over the exposed end of the bar so that contact with the end of the bar from the general axial direction is intercepted by the load spreading cap;

at least two retaining members for engagement with the reinforcing bar so as to locate and retain the load spreading cap at the end of the bar;

a support portion for the load spreading cap, the support portion generally surrounding the end of the bar in use, the retaining members being operatively connected to the support portion and arranged to contact and to bear against the bar at points located lengthwise of the bar, the retaining members being resiliently movable so as to contact the bar so that the contact points are along respective contact lines which are substantially parallel to the axis of the bar so that there is no significant inclination of the contact lines in the axial direction which would otherwise cause a tendency of the bar protection cap to creep along the bar and disengage from the end thereof, the load spreading cap including a substantially impenetrable insert portion which is made of a structurally resistant material so as to resist penetration of the load spreading cap by the end of the bar upon the occurrence of an externally applied substantial magnitude impulse loading upon the load spreading cap, the insert portion comprising a metal disc moulded inside of the protection cap, the support portion being securely fastened to the metal disc.

* * * * *